US005997204A

United States Patent [19]

Ducrocq

[11] Patent Number: 5,997,204

[45] Date of Patent: Dec. 7, 1999

[54] RETRACTABLE BALL-POINT PEN

[75] Inventor: Yves Ducrocq, Pont de briques, France

[73] Assignee: Societe BIC, Clichy, France

[21] Appl. No.: 08/814,867

[22] Filed: Mar. 11, 1997

[30] Foreign Application Priority Data

Mar. 12, 1996 [EP] European Pat. Off. ..... 96890046

[51] Int. Cl.[6] ..... B43K 5/16

[52] U.S. Cl. ..... 401/109; 401/110

[58] Field of Search ..... 401/109, 110, 401/111; 200/526, 527, 528

[56] References Cited

U.S. PATENT DOCUMENTS

| | | | |
|---|---|---|---|
| 1,332,378 | 3/1920 | Bramming | 200/520 |
| 3,064,624 | 9/1962 | Hechtle | 120/42.03 |
| 3,792,931 | 2/1974 | Ganz | 401/109 |
| 4,991,988 | 2/1991 | Snell et al. | 401/109 |

FOREIGN PATENT DOCUMENTS

| | | |
|---|---|---|
| 1195456 | 4/1958 | France . |
| 1431346 | 4/1965 | France . |
| 1108589 | 9/1956 | Germany . |
| 1248508 | 8/1967 | Germany . |
| 291815 | 8/1971 | Germany . |
| 312462 | 1/1974 | Germany . |
| 1039057 | 4/1965 | United Kingdom . |
| 1169489 | 9/1967 | United Kingdom . |

*Primary Examiner*—David J. Walczak
*Attorney, Agent, or Firm*—Pennie & Edmonds LLP

[57] ABSTRACT

An operating mechanism of a retractable ball-point pen including a ring mounted over a pin. The pin has at one end thereof a push button and at the other end thereof a portion having a greater diameter. Additionally, the pin has at least one pair of ribs which interact with grooves and saw-toothings on at least one end of the ring. The ends of the ribs are preferably provided with inclined lifting surfaces. To facilitate assembly, the saw-toothings may be symmetrically formed such that the direction of insertion into a pen housing is not critical. Preferably, the saw-toothings of the ring extend only over an inner partial portion of the wall thickness of the ring and the outer partial portion of the wall thickness of the ring forms a plane end face. A pen housing in which the operating mechanism may be positioned has axially extending supports configured to support the ring, preferably by engaging the plane end face of the ring.

16 Claims, 5 Drawing Sheets

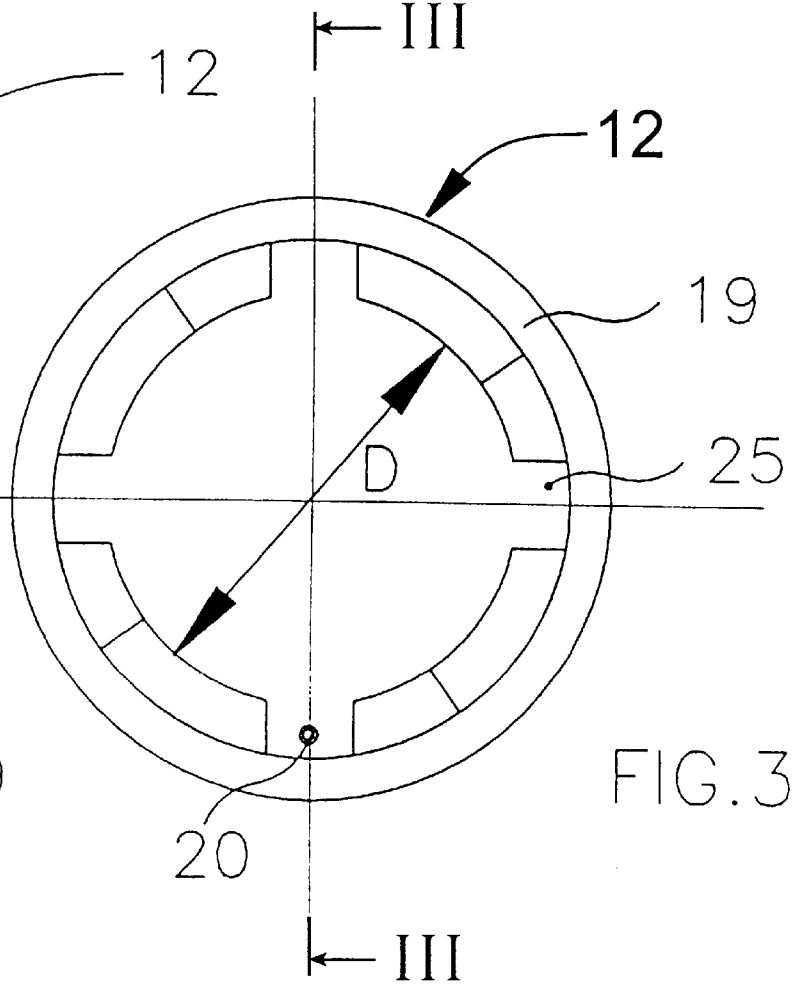
FIG. 3
Fig. 3
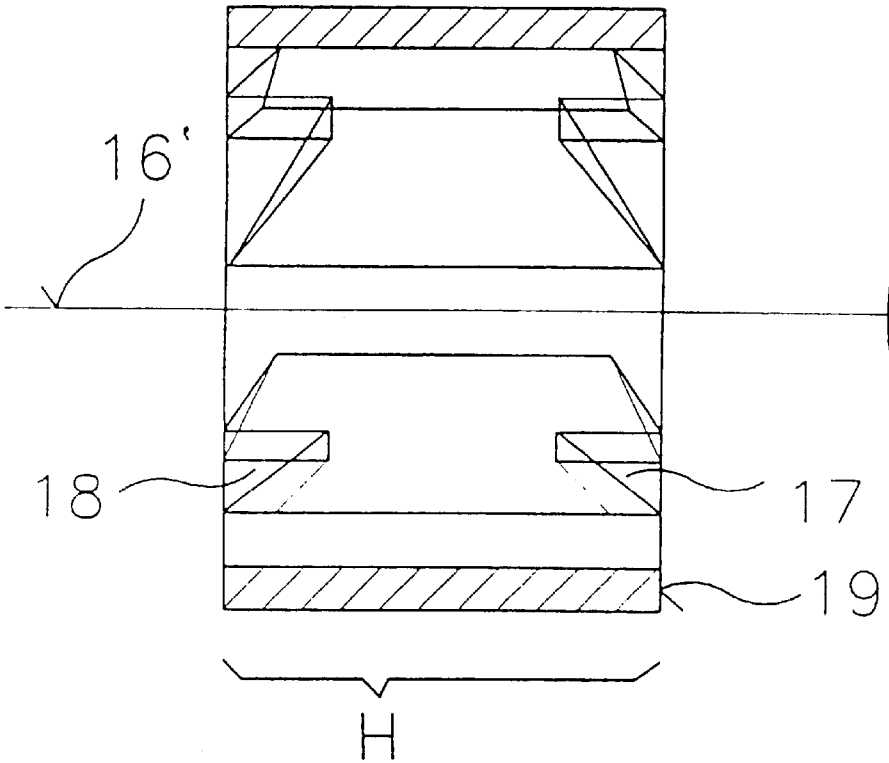
Fig. 3A

RETRACTABLE BALL-POINT PEN

TECHNICAL FIELD

The invention relates to a retractable or mechanical ball-point pen operating mechanism.

BACKGROUND ART

Retractable or mechanical ball-point pens include a housing in which a tube or cartridge with an ink reservoir and a writing point is inserted. By means of a push button and an operating mechanism, the reservoir tube can be moved back and forth between a writing position in which the writing point protrudes out of the housing and a position of rest in which the writing point is located within the housing. A spring for pressing the reservoir tube in the direction of the position of rest is arranged between the housing and the reservoir tube. The operating mechanism is also received in the housing; the push button of the operating mechanism protrudes out of the housing and the reservoir tube presses on the operating mechanism on the side facing away from the push button. The housing is usually composed of at least two components; in that case, the housing is composed of a long component at the side of the writing point and a shorter component facing the push button, wherein the long component has an internal thread and the short component has a corresponding external thread. While many of these devices exist, assembly complications lead to disadvantages in high speed manufacturing.

SUMMARY OF THE INVENTION

The present invention overcomes these disadvantages in providing an operating mechanism for a ball-point pen that includes a pin member which has at one end thereof a push button and at the other end a portion of increased diameter. The pin member also has at least one pair of ribs which interact with grooves and saw-toothings of a ring member that is slideably and rotatably mounted on the pin member. In the present operating mechanism, the ends of the ribs on the push button side of the pin member are provided with inclined lifting surfaces to facilitate movement of the ring member over the ribs independently of the position of the grooves.

In a preferred embodiment, the sliding movement of the ring member is enhanced by providing the saw-toothings only over an inner partial portion of the wall thickness of the ring member, while an outer partial portion of the wall thickness on each end of the ring member is provided with a planar end face. This enables the tips of the teeth to lie substantially flush with the planar end face, so that a pushing tool can be used to mount the ring member onto the pin member without damaging the saw-toothings. This, in turn, unexpectedly facilitates assembly of the pen during manufacture.

BRIEF DESCRIPTION OF THE DRAWINGS

The invention is illustrated in the drawings in the form of preferred embodiments and shall be explained in more detail below with the aid of the drawings.

In the drawings:

FIG. 3 shows a ring which interacts with the push button according to the invention and forms an operating mechanism together with the push button;

FIG. 3A is a cross-sectional view along line III—III of the ring of FIG. 3;

DETAILED DESCRIPTION OF THE PREFERRED EMBODIMENT

Figure 2:
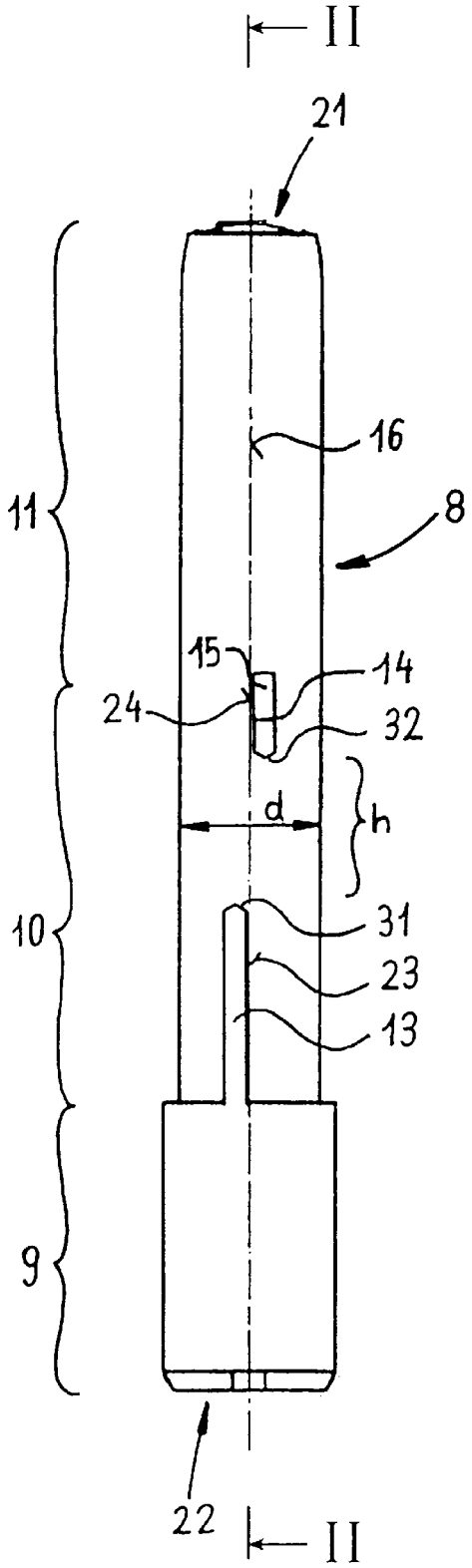
FIG. 2 shows a push button according to the invention.
Figure 2A:
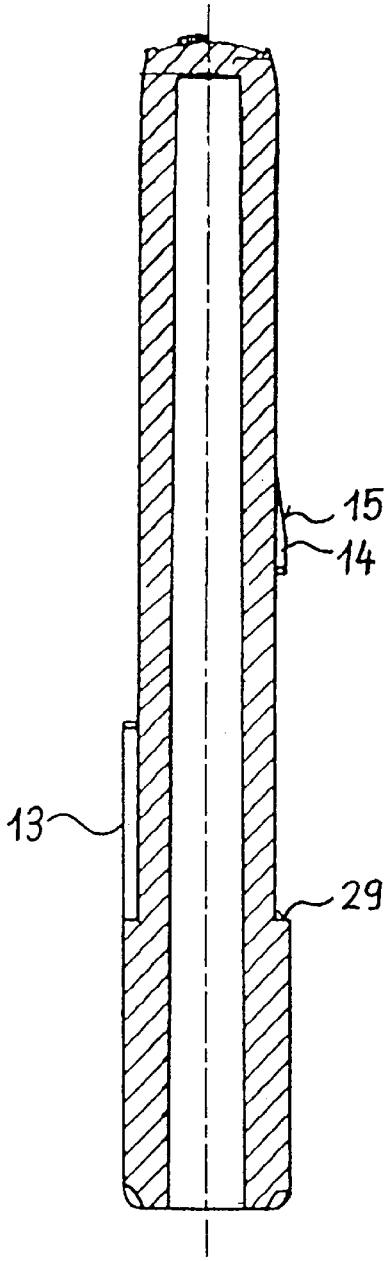
FIG. 2A is a cross-sectional view along line II—II of the push button of FIG. 2.

A known operating mechanism for a ball-point pen is similar to that shown in FIGS. 2 and 2A, and includes an essentially circular cylindrical pin 8 which forms the push button 21, on the one hand, and which, on the other hand, rests with its end face 22 against the reservoir tube for interaction therewith. The pin 8 has an axial portion 9 facing the reservoir tube. The diameter of the axial portion 9 is greater than the diameter of the other axial portions 10, 11 of the pin 8. In the axial portion 10, located adjacent to the axial portion 9, the pin 8 has on its outer surface oblong ribs 13, 14 which extend parallel to the axis 16 of the pin 8. At least two of such ribs 13, 14 are provided; however, usually four or even more ribs 13, 14 can be provided.

The ribs 13 which are located adjacent the portion 9 extend radially preferably up to the radius of the axial portion 9. The rib 14 preferably have a smaller radial height. The ribs 13, 14 have the same thickness in circumferential direction. The ribs are always arranged in pairs and have the following geometric configuration.

The rib 13 facing the writing point is mounted on the pin 8 so as to extend over a predetermined axial length starting from the axial portion 9; the other rib 14 facing the push button is spaced in axial direction by a distance h from the rib 13 facing the writing point, so that a portion of the outer surface of the pin remains without ribs in axial direction between the ends of the two ribs which face each other.

In addition, the two ribs are offset relative to each other in circumferential direction, so that one side 23 of one rib 13 is in alignment with the other side 24 of the other rib 14, so that the two ribs 13, 14 are located immediately next to one another when viewed in the in axial direction.

If the sides of the ribs do not extend in radial planes, the above-described relation applies to the bases of the sides of the ribs. If a plurality of such corresponding pairs of ribs are provided, they are uniformly distributed over the circumference and all are offset in the same direction.

The pin 8 interacts with a ring 12, as shown in FIGS. 3 and 3A, which has the following features. The inner diameter D of the ring 12 corresponds to the outer diameter d of the pin 8, so that the ring 12 can rapidly slide and rotate along the pin 8. The ring 12 has on its inner surface axially extending grooves 25 which make it possible for the ring 12 to be moved rapidly over the ribs 13, 14 of the pin 8 in axial direction. The number of grooves 25 is selected in such a way that the manner of operation described further below is possible; for example, if two pairs of ribs 13, 14 are provided, the ring 12 has four grooves 25. The ring is provided at each of its two end faces with a saw-toothing 17, 18. The inclinations of the two toothings are aligned in the same direction. The axial distance of the ring between the tips of the teeth, i.e., the height H, is greater than the axial distance h between the two ends of corresponding ribs 13, 14 which face each other; the axial distance between the bases of the teeth being smaller than h.

The above-described measures make it possible for the ring 12 to be rotated in the ribless portion of the pin 8 if it is subjected to a reciprocating axial movement of the pin and the tips of the teeth of the toothing 17 yield or must yield to the ends of the ribs 13, 14 facing each other.

Preferably, two pairs of ribs are provided. The orientation of each rib in circumferential direction is 22.5°, so that there are eight saw-teeth and four grooves.

Figure 5:
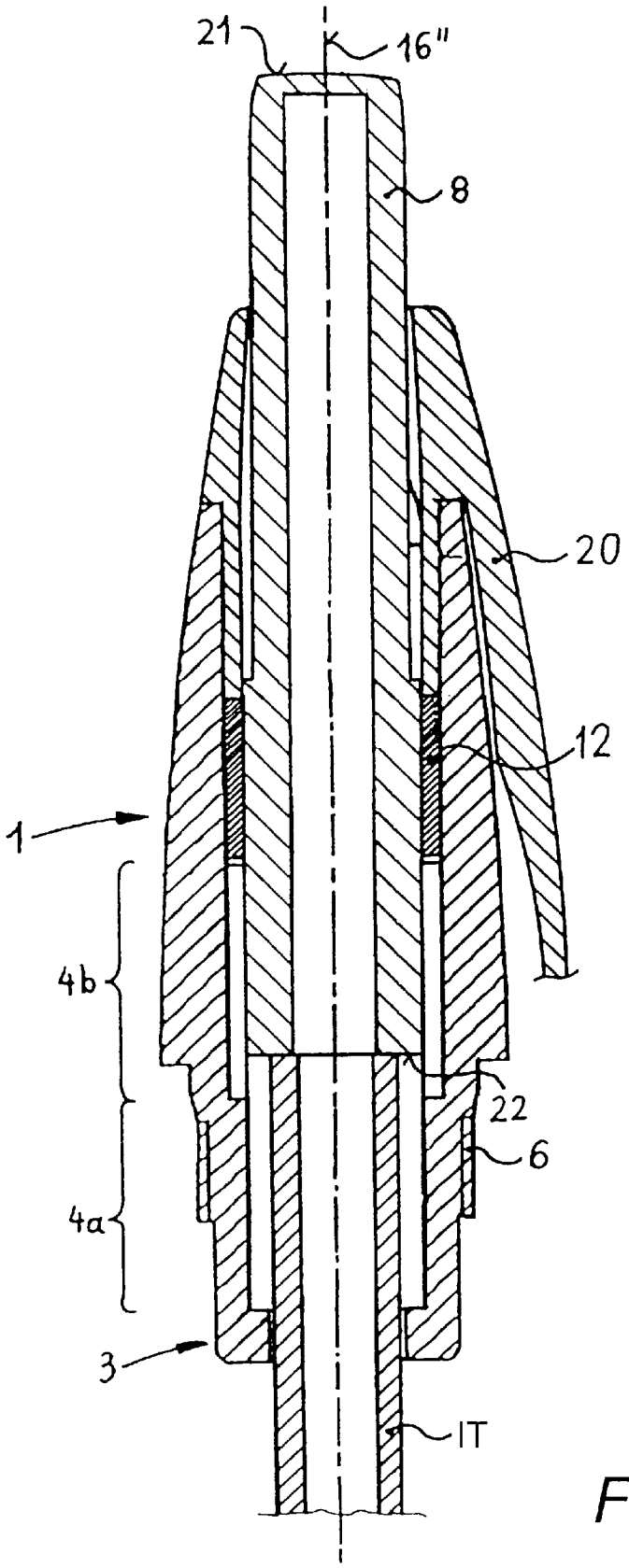
FIG. 5 shows a cross-sectional view of an assembled ball-point pen in the position of rest thereof.

In the assembled state of the ball-point pen, the ring 12 is supported in a correspondingly constructed component 12' of a passage opening 2 of the housing 1 by means of clamping member 20, as shown in FIG. 5, so that the ring 12 essentially cannot be moved in the axial and radial directions, while it can be rotated about its axis 16' which at least essentially coincides with the axis 16" of the ball-point pen and the axis 16 of the pin 8. The passage opening 2 has on the side facing away from the clamping member 20 a portion 3 having a reduced diameter.

The pin 8 is inserted into the ring 12 in such a way that the ring is essentially located at that location of the pin 8 which is axially between the ribs 13 and 14, wherein additionally the axial portion 9 of the pin 8, which has a greater diameter than the other pin portions, is located in a portion 4 of the passage opening 2 of the housing component 1 located adjacent the portion 3.

The diameters are operatively associated with each other in such a way that the pin 8 can move axially and in the circumferential direction in the portion 4, while it cannot pass through the portion 3 of the passage opening.

A spring serving to press the pin 8 rearwardly in the axial direction acts through the ink reservoir tube IT on the end face 22 of the pin 8. Depending on the circumferential position of the ring 12 relative to the pin 8, the ribs 13 of the pin 8 facing the writing point can be inserted into the grooves 25 of the ring 12, so that the pin 8 is pushed rearwardly by the reservoir tube IT into a position of rest, or the ribs 13 are held in the base between two teeth of the saw-toothing 17, so that the writing point of the reservoir tube protrudes out of the housing.

FIG. 5 shows the rearward portion of a ball-point pen according to the invention in its position of rest. The reservoir tube IT pushes the pin 8 rearwardly until the shoulder 29 of the pin 8 rests against the ring 12, as shown in FIG. 2, and prevents any further movement in that direction. In the illustrated position of rest, the rib 13 of the pin 8 is inserted into the groove of the ring 12, so that only the outer portion of the wall thickness of the ring 12 which is without grooves is visible in FIG. 5.

In the writing position of the ball-point pen, the end face 22 of the pin 8 is located near the portion 3 and the rib 14 of the pin 8 is inserted into the groove 25 of the ring 12, while the push button 21 protrudes only by a small distance out of the housing component 1.

When a pressure is applied to the push button 21 against the force of the spring, so that the pin 8 is moved forwardly to a sufficient extent in the axial direction relative to the housing and to the ring, the following occurs starting from the writing position of the ball-point pen.

When pressure is applied to the push button 21, the pin 8 is moved against the force of the spring by a distance in the direction toward the writing point of the ball-point pen, so that the toothing of the ring 12 facing the writing point releases the corresponding toothing of the rib 13 is facing the writing point, and the toothing facing the of the push button is moved into the area of the corresponding rib 14 facing the push button. Since the ribs 13 offset in circumferential direction relative to the rib 14, a further forward movement of the pin 8 causes the ring 12 to be rotated until the rib 14 faces the push button is received in the base of the tooth, and a further displacement of the push button relative to the ring and, thus, relative to the housing is impossible as a result.

When the push button 21 is released, the spring pushes the push button 21 toward the rear by means of the reservoir tube, the toothing facing the push button releases the rib 14 facing the push button and the rib 13 facing the writing point is again moved into the area of the toothing facing the push button. The resulting rotation of the ring has caused the rib 13 facing the writing point to have traveled by a tooth as compared to the initial position and to have been moved into the area of a groove 25 of the ring 12, so that the pin 8 can be moved further under the influence of the spring than was the case in the initial position: the reservoir tube is now in the retracted position, as illustrated in FIG. 5.

When the push button 21 is again actuated in this position, which is now the initial position, the sequence described above is repeated, with one difference being that the axial travel distance of the pin until the toothing facing the push button makes contact with the rib 14 facing the push button is longer than previously, and the second difference being that the ribs 13 facing the writing point are offset relative to the grooves 25, so that the pin 8 and the reservoir tube are held in their forward positions and the initial writing position described first is again reached.

Mechanisms of the type described above have been known for a long time and have essentially proved useful in practice. They have the disadvantage that, during the assembly of the operating mechanism, the ring 12 must be slid over the rib 14 facing the push button; this makes it necessary that the relative angular position between the ring 12 and the pin 8 can be controlled and changed as desired, in order to place the grooves in an aligned position with the ribs 14. In fully automatically operating assembly machines having cycles of 200 ball-point pens per minute, this requires extreme precision and leads to problems time and again.

It is the object of the invention to prevent these disadvantages and to provide an operating mechanism which can be assembled without problems.

In accordance with the invention, as shown in FIGS. 2 and 2A the ends of the one or more ribs 14 on the push button side are provided with inclined lifting surfaces 15, so that the ends of these ribs rise in the shape of a ramp from the outer surface of the pin 8. Surprisingly, this makes it possible to push the ring 12 over the ribs 14 independently of the position of the grooves 25 relative to the ribs 14, wherein the ring is elastically expanded for a short period of time until it reaches the area between the ribs 13, 14, i.e., the area h shown in FIG. 2.

The ring is made of suitable engineering plastic, for example, Delrin 500, a product of E.I. du Pont de Nemours and Co., Inc., USA, Celcon, a product of Celanese Corporation, USA, Polyamid, Nylon 6.6, a product of Akzo n.V., Netherlands.

In a preferred embodiment in which sliding of the ring 12 into the pin 8 is further facilitated, it is provided that the saw-toothings 17, 18 only extend over an inner partial portion of the wall thickness of the ring 12 and that the outer partial portion of the wall thickness on both end faces of the ring is provided with a plane end face 19 extending perpendicularly to the axis 16', as shown in FIG. 3A of the ring 12, wherein the end face 19 is located preferably in the plane of the tips of the teeth or projects above the tips by a small amount, for example, by 0.05 mm.

The above-described feature makes it possible to use a pushing tool having a plane annular surface for mounting the ring 12 on the pin 8 and to reliably prevent any damage to the saw-toothing 17, 18.

Moreover, this embodiment has the completely unforeseeable advantage that the ball-point pen housing can be constructed with a configuration which is more favorable with respect to the manufacture thereof in the area of the operating mechanism: in many types of ball-point pens which use the above-described operating mechanism, the housing is divided in the area of this mechanism, wherein the two components are connected to one another by means of a thread 6. The operating mechanism is arranged in the housing component 1 facing the push button, while the housing component facing the writing point receives the ink reservoir tube 21 and the spring.

Figure 1:
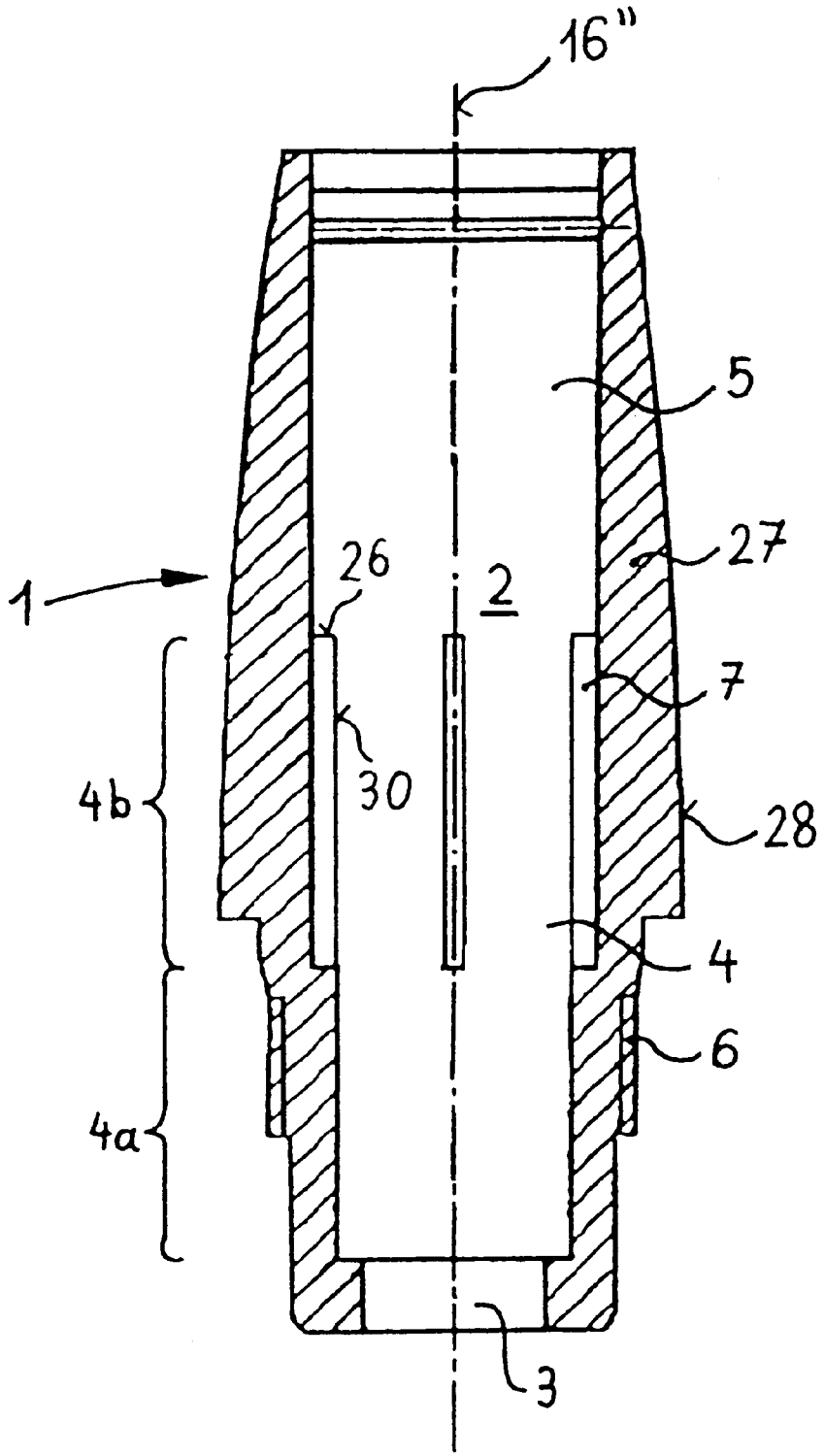
FIG. 1 shows a cross-sectional view of a cap for receiving an operating mechanism according to the invention.

It is necessary that, aside from furrows, rings or polygonal configurations which are intended to facilitate the support of the ball-point pen during writing, the outer surface of the ball-point pen is smooth without edges and steps. This means that, as shown in FIG. 1, in the area of the external thread which is usually located slightly toward the writing point from the seat of the ring, an increased material thickness 27 is unavoidable because the passage opening 2 which receives the operating mechanism narrows in the form of a step or a shoulder in order to form a seat for the ring, while the outer surface expands outwardly in the area 28, in order to facilitate a smooth transition to the outer surface of the housing component facing the writing point in the end area of the thread, wherein the housing component facing the writing point has an internal thread.

Figure 4:
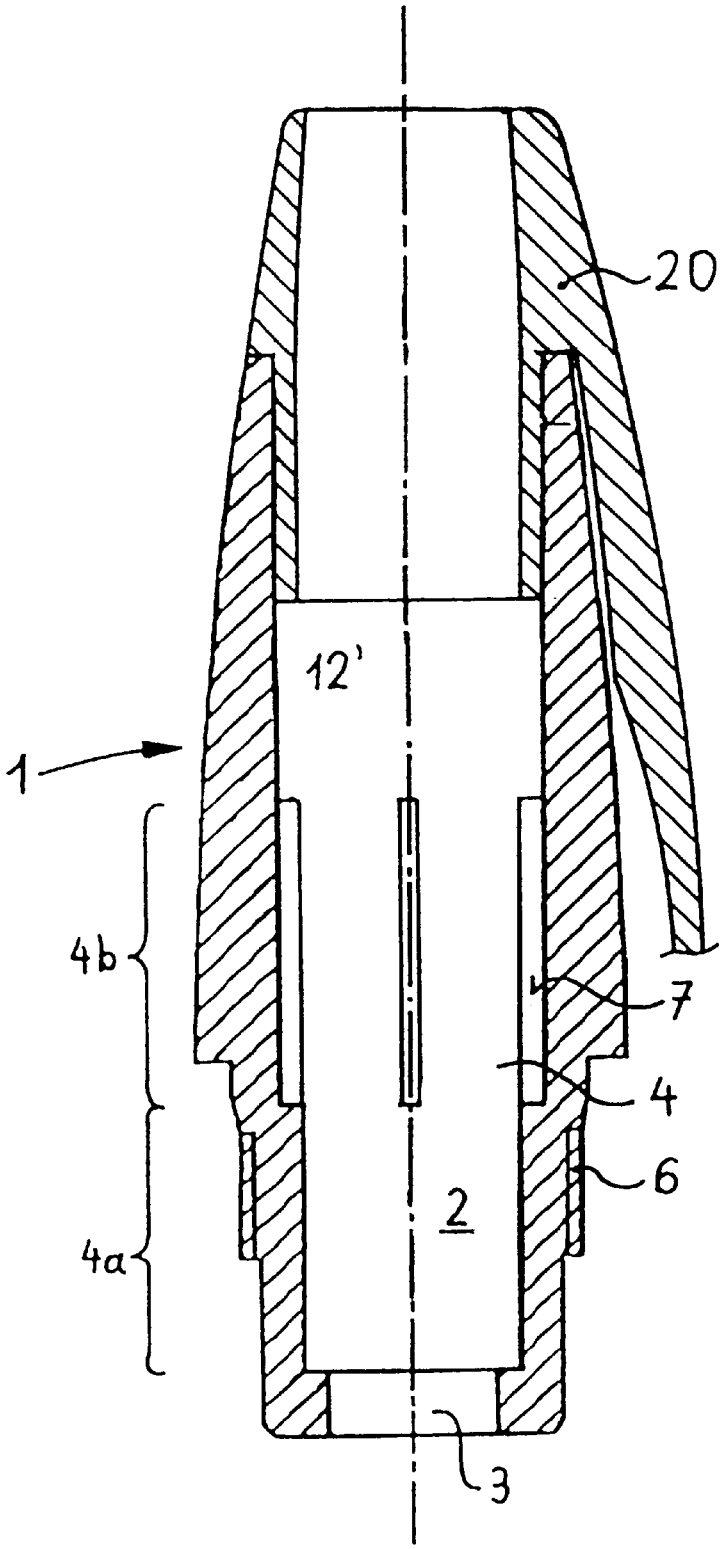
FIG. 4 shows a cross-sectional view of a cap as shown in FIG. 1 including support piece, but without operating mechanism.

With the configuration of the ring 12 having a smooth outer end face 19, which is preferred according to the invention, it is now possible to provide the passage opening 2 in this area 4*b* with a greater diameter than previously and, instead of the shoulder or the step, to have axially extending thin supports 7 which protrude inwardly from the inner surface of the passage opening, wherein the end faces 26 of the supports 7 which face the push button form the seat for the ring. This is shown in FIGS. 1 and 4. Preferably, four of such supports 7 are provided, however, it is also possible to provide more or fewer supports 7.

Adjacent the portion 4*b* is located a portion 4*a* which, as is the case in the state of the art, has an internal diameter which forms a guide for the portion 9 of the pin 8. Consequently, the inner surfaces 30 of the supports 7 preferably coincide with the extension of the outer surface of the portion 4*a*. The portions 4*a* and 4*b* together form the portion 4 which carries out the same guiding and support operations as is the case in the state of the art.

This configuration of the housing component, which is only possible as a result of the plane end faces 19 of the ring 12, not only saves material, which is significant because of the extremely high numbers of ball-point pens produced, but additionally the manufacture of the housing components is simplified, so that the operating cycles of the injection molding tool are significantly increased and the probability of waste is reduced. The reduction of waste is achieved because of supports 7 allow the wall thickness of the housing 1 in the portion 4*b* to be reduced. Thus, large material thicknesses were avoided which would otherwise lead to problems with respect to accuracy to size in injection molded articles during cooling and hardening, which problems occur time and again even when the production conditions are precisely maintained and narrowly prescribed.

The invention is not limited to the described embodiment; rather, the invention can be modified in various ways. For example, it is possible to provide three or four pairs of ribs facing each other, instead of two of such pairs of ribs; however, the embodiment described above is preferred because of the more easily possible elastic deformation of the ring when only two pairs of ribs are provided. If three or four pairs are provided, it is necessary to increase the number of grooves and teeth of the ring accordingly. The number of grooves should be twice the number of ribs.

It is possible to extend the plane end faces of the ring higher above the saw toothing; however, because of the resulting increase in the structural length, this is only of interest in special applications.

In the illustrated embodiment, the inclination of the ends facing the push button of the ribs facing the push button relative to the pin axis 16 is 13.5°; however, it is also possible to use different angles, wherein it is only necessary to take into consideration the forces occurring during the assembly of the ring, wherein these forces must be such that they can be adsorbed by the ring.

In accordance with a further development of the invention, as shown in FIG. 2, the ends 31, 32 of the ribs 13, 14 facing each other are provided with V-shaped tips in order to achieve a better interaction with the bases of the teeth of the respective saw toothing 17, 18 of the ring 12. When the end faces of the ring are mounted during the assembly in a position turned by 180°, the saw-toothing of the ring faces in the other direction. This makes it necessary to construct these rib ends 13, 14 symmetrically in order to produce the same conditions for absorbing the writing pressure in both positions. As a result, it is not necessary to supply the rings in an oriented manner when they are assembled.

What is claimed is:

1. An operating mechanism for a ball-point pen, comprising:

a pin member having a first end with a push button, a second end with a portion of increased diameter, and at least one pair of ribs between said first and second ends; and a ring member operatively associated with said pin member, said ring member having first and second ends with saw-toothings on at least one of said first and second ends, said ring member being positioned about said pin member for operative interaction of said saw-toothings with said at least one pair of ribs.

2. The operating mechanism of claim 1, wherein said saw-toothings are provided only on an inner portion of said ring member while an outer portion of said ring member forms a planar end face.

3. The operating mechanism of claim 2, wherein both said first and second ends of said ring member form a planar end face.

4. The operating mechanism of claim 1, wherein said ribs of said at least one pair of ribs have V-shaped ends facing said ring member.

5. The operating mechanism of claim 4, wherein:

said pin has a longitudinal axis;

said saw-toothings are inclined relative to said pin longitudinal axis; and said V-shaped ends have sides inclined relative to said pin longitudinal axis at essentially the same angle as the inclination of said saw-toothings of said ring member.

6. A ball-point pen comprising a housing component having a passage opening which has at least two portions of different diameters including a first portion having a greater diameter and a second portion having a smaller diameter, and at least two axially extending supports provided in said first portion, in combination with the operating mechanism of claim 1 mounted in said passage opening.

7. The pen of claim 6, wherein said supports have end faces facing said push button of said member and forming a seat for said ring member.

8. The pen of claim 7, wherein each support has an inner surface which forms a guide for said increased diameter portion of said second end of said pin member, and which coincides with the outer surface of said first portion of said housing.

9. The operating mechanism of claim 6, wherein:

said first end of said ring member faces said first end of said pin member;

said second end of said ring member faces said second end of said pin member;

said second end of said ring member forms a planar end face;

said passage of said housing has an inner surface; and said axially extending supports are in the form of axially extending thin supports protruding inwardly from said inner surface of said housing passage and forming a seat for said planar end face of said ring member.

10. The operating mechanism of claim 1, wherein:

said at least one pair of fibs includes a first pair of ribs facing said first end of said pin member and a second pair of ribs facing said second end of said pin member and spaced from said first pair of ribs;

both said first and second ends of said ring member have saw-toothings; and said ring member is positioned between said first and second pair of ribs with said saw-toothings on said first end of said ring member facing said first pair of ribs for operative interaction therewith and said saw-toothings on said second end of said ring member facing said second pair of ribs for operative interaction therewith.

11. The operating mechanism of claim 1, wherein:

said ring member is positioned between at least one of said pair of ribs and said second end of said pin member; and said at least one of said pair of ribs is provided with an inclined lifting surface in the shape of a ramp rising outward from said pin member in the direction of said second end of said pin member to facilitate insertion of said ring member over said first end of said pin member and over said lifting surface to said position between said at least one of said pair of ribs and said second end of said pin member.

12. An operating mechanism for a ball-point pen including a ring member having first and second ends, wherein each end of said ring has saw-toothings configured for interaction with another element of said ball-point pen operating mechanism, said saw-toothings on said first and second ends of said ring member being formed symmetrically with respect to each other.

13. The operating mechanism of claim 12, further comprising a pin member having first and second ends with first and second axially spaced apart ribs provided between said first and second ends of said pin member, said ring being positioned about said pin member with said saw-toothings of said first and second ends respectively facing said first and second ribs for operative interaction therewith.

14. The operating mechanism of claim 12, wherein said ring has an inner surface having axially extending grooves.

15. A ball-point pen comprising:

a housing having a first open end and a second open end; and an operating mechanism including a ring member surrounding a pin member;

wherein:

said pin member includes a push button extending through said first open end of said housing;

said housing is provided with at least two axially extending supports adjacent said second open end, said supports having a support surface facing said first open end of said housing; and said ring member is supported by said supports of said housing and thereby is prevented from passing through said second open end of said housing.

16. The ball-point pen of claim 15, wherein:

said pin member has a first end on which said push button is provided, a second end facing said second open end of said housing, and at least one pair of ribs between said first and second ends of said pin member;

said ring member has a first end facing said first open end of said housing, a second end facing said second open end of said housing, and saw-toothings on said second end of said ring member;

said ring member is positioned about said pin member for operative interaction of said saw-toothings with said at least one pair of ribs;

said saw-toothings are provided on an inner portion of said second end of said ring member while an outer portion of said second end of said ring member forms a planar end face; and said supports of said housing support said planar end face on said outer portion of said second end of said ring member.

* * * * *